US008091307B2

(12) United States Patent
Alhazmy

(10) Patent No.: US 8,091,307 B2
(45) Date of Patent: Jan. 10, 2012

(54) CONVECTION BAFFLE FOR HOLLOW BLOCKS

(75) Inventor: Majed Moalla Alhazmy, Jeddah (SA)

(73) Assignee: King Abdulaziz University, Jeddah (SA)

( * ) Notice: Subject to any disclaimer, the term of this patent is extended or adjusted under 35 U.S.C. 154(b) by 88 days.

(21) Appl. No.: 12/461,623

(22) Filed: Aug. 18, 2009

(65) Prior Publication Data

US 2011/0041444 A1 Feb. 24, 2011

(51) Int. Cl.
*E04B 1/74* (2006.01)

(52) U.S. Cl. ..... 52/405.1; 52/404.1; 52/405.4; 52/406.1; 52/406.2; 52/406.3

(58) Field of Classification Search ..... 52/405.1, 52/404.1, 405.4, 406.1, 406.2, 406.3, 407.1, 52/407.3, 407.5, 459–472, 716.1
See application file for complete search history.

(56) References Cited

U.S. PATENT DOCUMENTS

| | | | | |
|---|---|---|---|---|
| 110,764 | A | 1/1871 | Johnson | |
| 274,449 | A | 3/1883 | Lee | |
| 1,611,373 | A | 12/1926 | Reagan | |
| 1,686,373 | A | 10/1928 | Foster | |
| 1,720,306 | A | 7/1929 | Tremper | |
| 1,887,701 | A | 11/1932 | Stevens | |
| 2,176,805 | A | 10/1939 | Scheibl | |
| D179,185 | S | 11/1956 | Branham | |
| 2,832,445 | A * | 4/1958 | Burgin | 52/483.1 |
| 2,852,934 | A * | 9/1958 | Amundson | 52/405.1 |
| 4,106,252 | A * | 8/1978 | Rutten | 52/82 |
| 4,380,887 | A * | 4/1983 | Lee | 52/405.1 |
| 4,462,195 | A * | 7/1984 | Nickerson | 52/405.1 |
| 4,551,959 | A * | 11/1985 | Schmid | 52/309.12 |
| 4,597,238 | A | 7/1986 | Vadala' | |
| 4,802,318 | A * | 2/1989 | Snitovski | 52/309.12 |
| 4,856,248 | A * | 8/1989 | Larson et al. | 52/405.1 |
| D304,500 | S | 11/1989 | VanWassehnova et al. | |
| D304,501 | S | 11/1989 | VanWassehnova et al. | |
| 5,209,037 | A * | 5/1993 | Kennedy et al. | 52/309.12 |
| 5,499,478 | A | 3/1996 | Rimmele | |
| 5,826,650 | A * | 10/1998 | Keller et al. | 165/236 |
| 5,842,276 | A * | 12/1998 | Asher et al. | 29/897.32 |
| 5,904,963 | A | 5/1999 | Blatter | |
| 6,167,624 | B1 * | 1/2001 | Lanahan et al. | 29/897.32 |
| D437,423 | S | 2/2001 | Lin | |
| 6,363,674 | B1 * | 4/2002 | Carver | 52/309.8 |
| D464,441 | S | 10/2002 | Luaces | |
| 6,494,012 | B2 * | 12/2002 | Seng | 52/841 |
| D527,467 | S | 8/2006 | Telford | |
| 2004/0068948 | A1 * | 4/2004 | Wrass | 52/309.7 |
| 2005/0204697 | A1 * | 9/2005 | Rue | 52/782.1 |
| 2006/0070320 | A1 * | 4/2006 | Otto | 52/232 |
| 2006/0075701 | A1 * | 4/2006 | Cretti | 52/223.8 |

FOREIGN PATENT DOCUMENTS

DE 2226460 12/1973

* cited by examiner

*Primary Examiner* — Eileen D Lillis
*Assistant Examiner* — Mark Wendell
(74) *Attorney, Agent, or Firm* — Richard C. Litman

(57) ABSTRACT

The convection baffle for hollow blocks increases the R-value of a hollow block when one or more convection dampers are received within passages defined through the hollow block. The convection baffle includes an upper wall having laterally opposed first and second side edges, a lower wall having laterally opposed first and second side edges, first and second laterally opposed sidewalls, and a central wall having opposed upper and lower edges. The convection baffle is substantially G-shaped. The convection baffle decreases convection current flow within the passage of the hollow block to increase the overall R-value of the hollow block.

7 Claims, 4 Drawing Sheets

CONVECTION BAFFLE FOR HOLLOW BLOCKS

BACKGROUND OF THE INVENTION

1. Field of the Invention

The present invention relates to construction materials, and particularly relates to a convection baffle for a hollow block providing thermal insulation, with the baffle increasing the R-value of the hollow block.

2. Description of the Related Art

In nations where hot weather prevails throughout most of year, such as the Kingdom of Saudi Arabia, a substantial amount of the total power consumption in the nation is expended cooling buildings by air conditioning. Electrical energy is primarily generated through the burning of fossil fuels, which release harmful gases, typically referred to as "greenhouse gases", into the atmosphere. These greenhouse gas emissions contribute to global warming and major changes in climate conditions. At least one-half of the volume of emissions from the power production process is in the form of harmful greenhouse gases.

Thus, sustainability and energy savings are important issues aimed at the reduction of energy consumption and production of greenhouse gas emissions. Therefore, it is necessary to improve the thermal loss standards of building construction elements.

Heat leak calculations are of particular importance, since thermal energy transfer through constructions materials (such as wall-forming bricks) directly relates to energy conservation in buildings, and ultimately determines the suitable R-value or U-factor for building elements. In calculating air conditioning cooling load, the heat transmission through walls, in particular, is considered as a major element contributing to loss of efficiency by heating the cooler, air-conditioned air inside the building.

A substantial amount of energy is consumed to compensate for heat transfer through building walls and ceilings. During the mid-1970's, designers first became aware of the life-cycle cost of buildings, thus initiating the design of energy efficient walls. Walls using hollow blocks were built for their structural and moisture diverting qualities. Hollow blocks are manufactured in a wide variety of styles and sizes. FIG. 3 illustrates a typical hollow block B of the type commonly referred to as a multiple-core hollow block or concrete masonry unit.

Hollow block B typically is substantially rectangular, having opposed upper and lower surfaces 110, 112, a pair of laterally opposed sidewalls 102, 104, and a plurality of open passages P defining cores formed transversely therethrough. Alternatively, block B may be described as a rectangular prism having a plurality of medial partition walls defining multiple cores through the block B. Today, hollow and dense cement or concrete blocks, also sometimes referred to as hollow blocks, are suitable and common alternatives to conventional bricks or construction blocks, and are widely used in construction. A typical block B, such as that shown in FIG. 3, may have a lateral width of approximately 20 cm, a height of approximately 20 cm and a transverse length of approximately 40 cm. As shown, nine 5 cm by 5 cm passages P are arranged as a 3×3 matrix or array, with the passages P extending transversely through block B. Passages P form air-filled cavities when blocks B are used to construct building facades.

Such hollow blocks are typically formed from cement, stone chips, stone dust or sand, and are not only cheaper to manufacture than conventional bricks or blocks, but have useful thermal properties. The modes by which heat transfer occurs include heat conduction in the solid sections of block B, along with natural convection and radiation transfer within the passages P. The outer surface 102 is exposed to solar radiation having a temperature of $T_h$, and the inner surface 104 is cooled by interior air conditioning, having a temperature of $T_c$, thus providing a thermal gradient for heat transfer to take place. The rate of heat transfer depends upon the material properties, shape and thermal parameters of the block. Typically, in the prior art hollow block B shown in FIG. 3, insulation is inserted within the passages P. In order to conserve energy through reduction of powered air conditioning within a building, constructing a block having optimal insulating properties, or a high R-value, is needed. Varying insulation material filling passages P, or varying the size, contouring and number of passages P typically only allows for variation in R-value of between approximately 20% and 30%. Thus, a convection baffle for hollow blocks solving the aforementioned problems is desired.

SUMMARY OF THE INVENTION

The convection baffle for hollow blocks increases the R-value of a hollow block when one or more convection dampers are received within passages defined through the hollow block. The convection baffle includes an upper wall having laterally opposed first and second side edges, a lower wall having laterally opposed first and second side edges, first and second laterally opposed sidewalls, and a central wall having opposed upper and lower edges.

The first sidewall has vertically opposed upper and lower edges, with the first side edge of the upper wall being joined to the upper edge of the first sidewall. The upper wall extends laterally therefrom, with the first side edge of the lower wall being joined to the lower edge of the first sidewall, and with the lower wall extending laterally therefrom. The upper edge of the central wall is joined to the second side edge of the upper wall, with the central wall extending downwardly therefrom such that the lower edge of the central wall is spaced apart from the lower wall. A lower edge of the second sidewall is joined to the second edge of the lower wall, with the second sidewall extending upwardly therefrom such that an open channel is formed between the second sidewall and the central wall.

The convection damper is adapted to be received within a passage of the hollow block so that the first sidewall thereof is positioned adjacent and contiguous to a relatively low temperature wall of the hollow block, with the second sidewall being positioned so as to extend substantially parallel to a relatively high temperature wall of the hollow block. The second sidewall is spaced apart therefrom, and convection air flow in a heated region defined by the relatively high temperature wall, the second sidewall and the central wall is at least partially canceled by convection air flow in a cooled region defined by the first sidewall, the central wall and the second sidewall.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
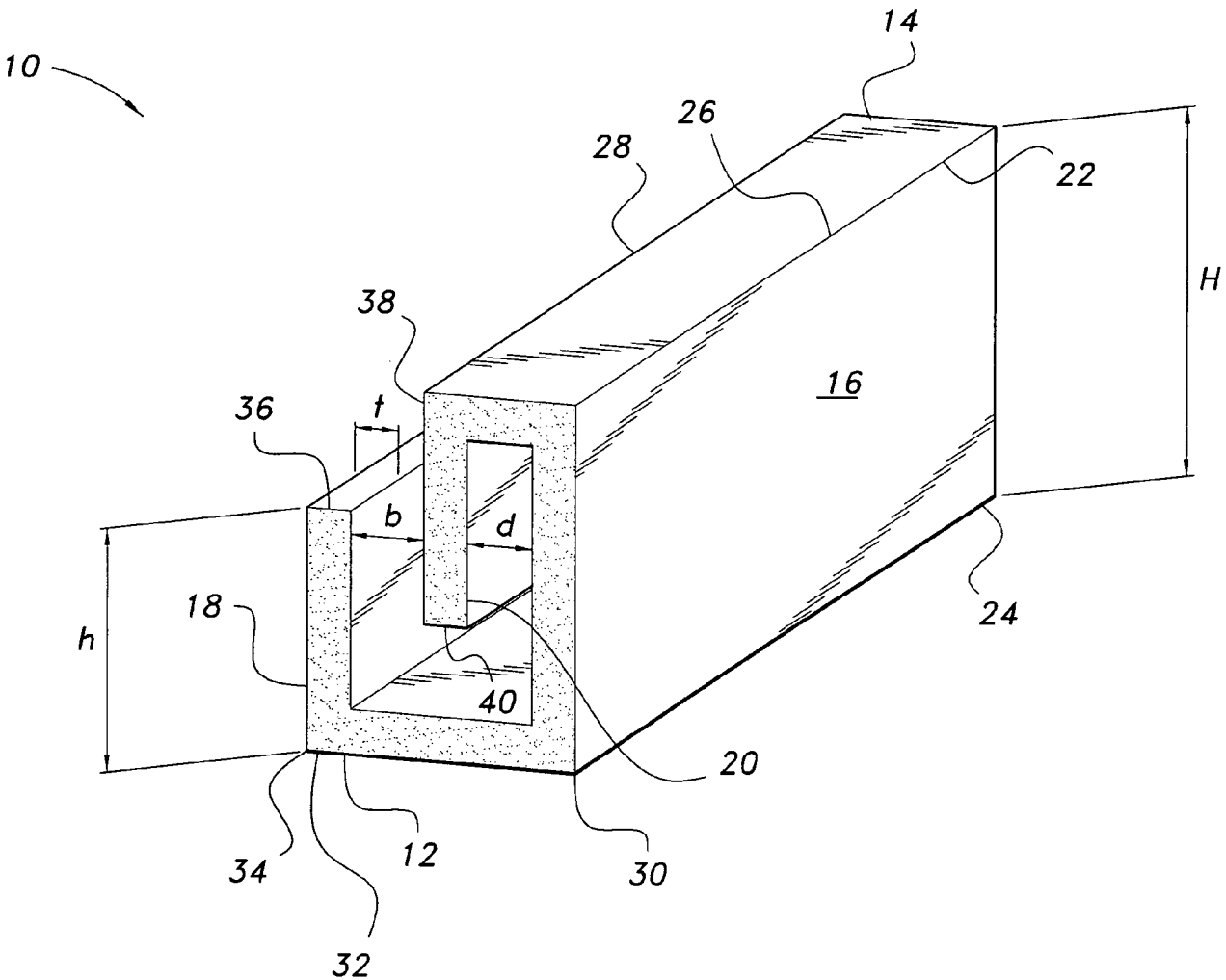
FIG. 1 is a perspective view of a convection baffle for hollow blocks according to the present invention.
Figure 2:
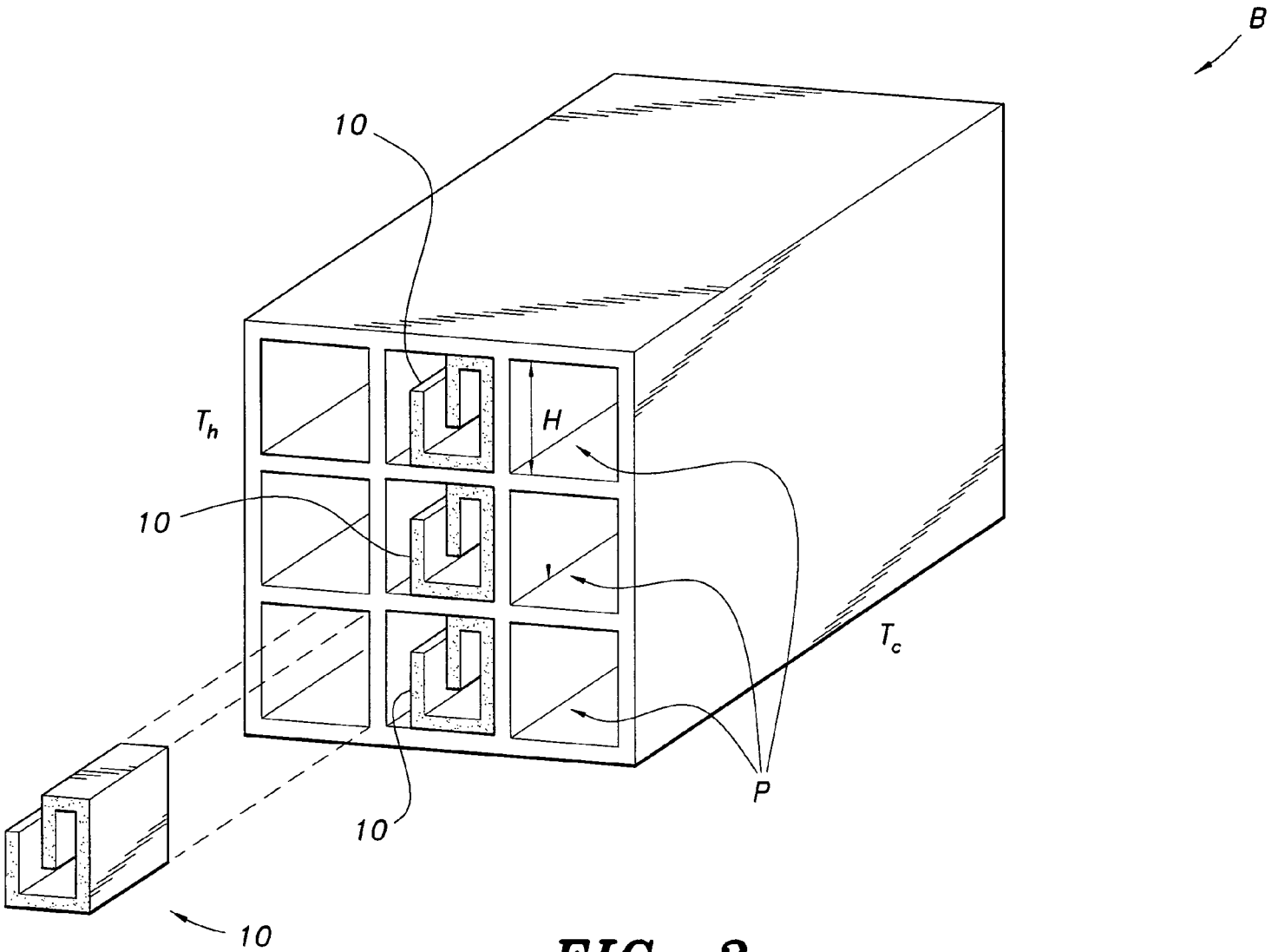
FIG. 2 is an environmental, perspective view of multiple convection baffles of FIG. 1 disposed within the open passages of an exemplary hollow block.
Figure 3:
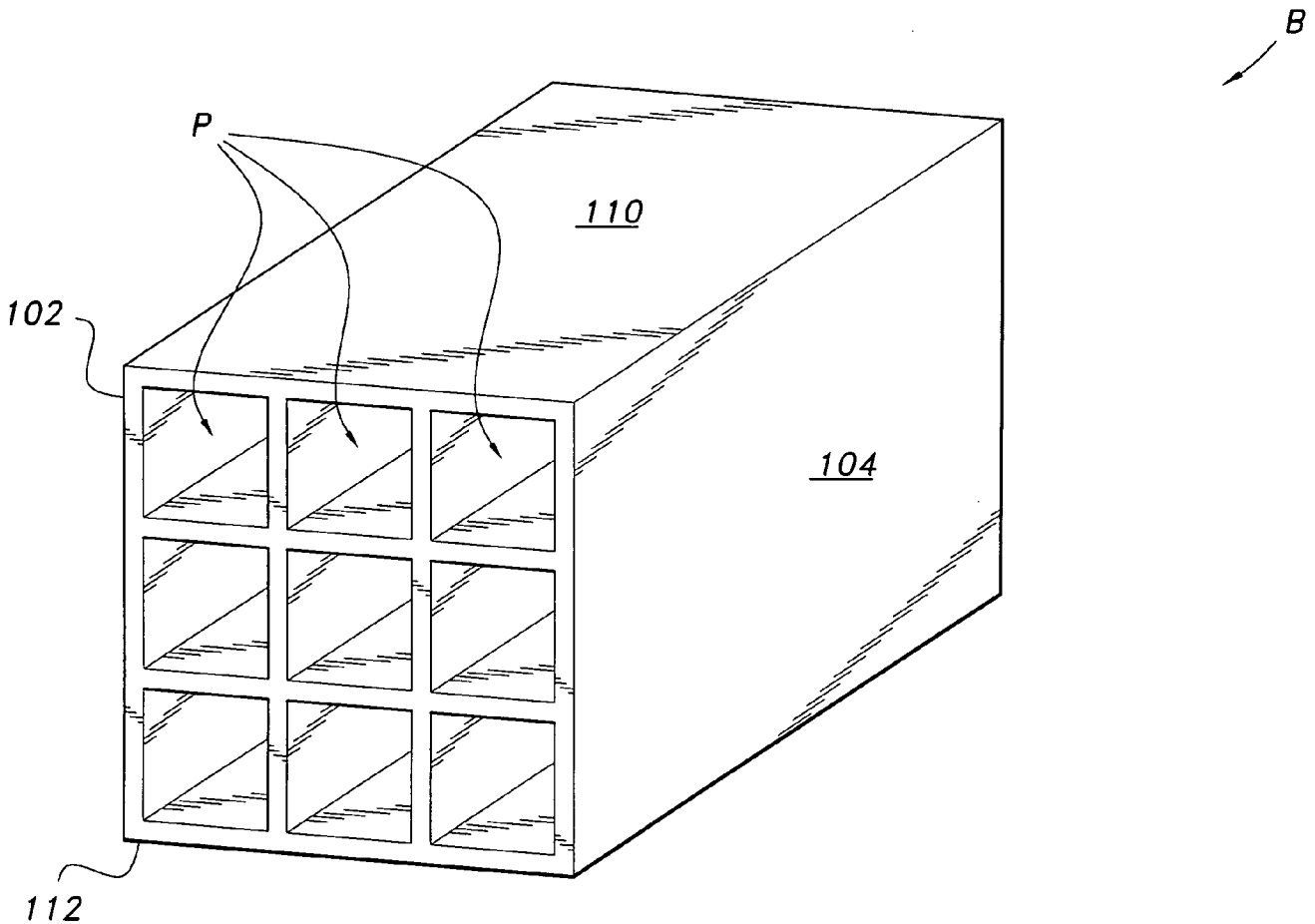
FIG. 3 PRIOR ART
FIG. 3 is a perspective view of a prior art hollow block.

Referring to FIG. 1, a convection baffle 10 for use with hollow blocks, such as exemplary prior art hollow block B of FIG. 2, is shown. The convection baffle 10 increases the R-value of block B when one or more convection dampers 10 are received within passages P. The R-value is a commonly used thermodynamic measure of thermal resistance, or the measure of thermal insulation, used in the building and construction industry. A relatively high R-value is a measure of effective thermal insulation in a building material.

It should be noted that block B is shown for exemplary purposes only, and that convection baffle 10 may be used with any desired hollow brick or hollow block. In some contexts, the term "brick" is used to refer to a block of ceramic material that is small enough to be picked up with one hand while the other hand is used to manipulate a trowel to spread mortar joining the bricks. Such bricks may be made from clay or shale, calcium silicate (typically sand and lime), or other material that is formed into rectangular prisms by the action of heat and subsequent cooling. A typical size for such bricks is about 8"×4"×2.25". They are commonly used for buildings (particularly for external veneer), pavement, chimneys, furnaces, and the like. These bricks may be solid, or they may have hollow passages for light weight and for insulation purposes.

By contrast, the term "block" or concrete masonry unit is used to refer to a larger unit that is typically used in foundation walls and the like. Blocks are typically made from cast concrete, i.e., Portland cement and aggregate materials. In high-density blocks, the aggregate material is usually sand and fine gravel. In low density blocks, also called cinder blocks or breeze blocks, the aggregate material may comprise fly ash or bottom ash. Section 2102 of the International Building Code defines a "concrete" masonry unit as a building unit or block larger than 12"×4"×4" made of cement and suitable aggregates, and defines the masonry unit as "hollow" when the net cross-sectional area is less than 75% of the gross cross-sectional area in any plane parallel to the load-bearing surface.

Figure 4:
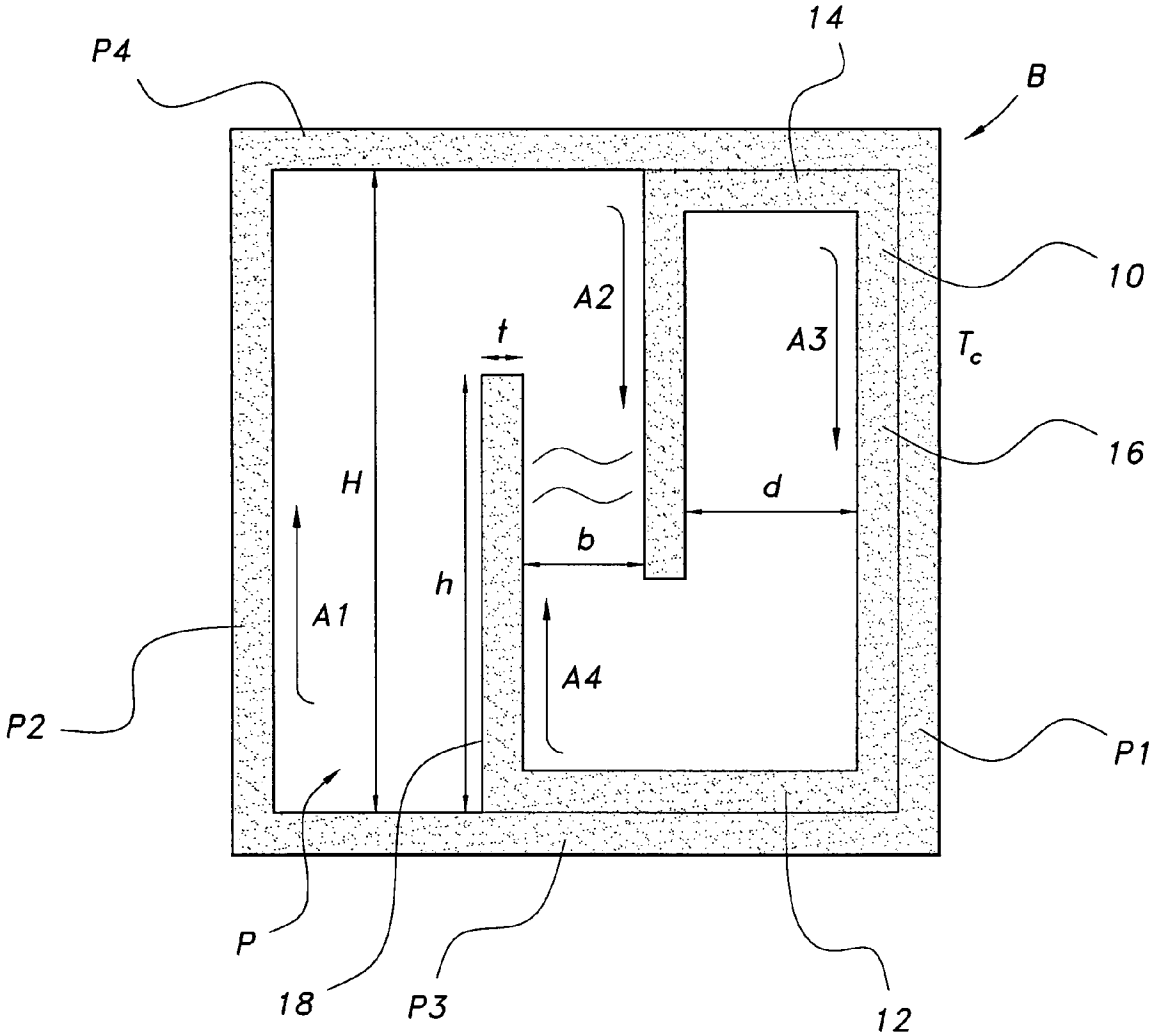
FIG. 4 is an environmental plan view of a hollow block having the convection baffle of FIG. 1 disposed therein, showing convection air currents about the baffle.

For purposes of the present application, the term "hollow block" may refer to either the smaller "brick" or the larger "block" described in the two preceding paragraphs. As best shown in FIG. 1, the convection baffle 10 includes opposed upper and lower walls 14, 12, respectively, a pair of laterally opposed sidewalls 16, 18, and a central, vertically extending wall 20. The convection baffle 10 is formed from a material having a relatively low thermal conductivity. As shown in FIGS. 1, 2 and 4, sidewall 16 has a height of H, which matches the height of each passage P formed through block B, allowing each convection baffle 10 to be securely and snugly fitted within a corresponding one of passages P. The laterally opposed sidewall 18 has a height of h, which is less than H, but is preferably greater than ½ H.

Each wall of convection baffle 10 is formed from a sheet having a thickness t, and sidewalls 16, 18 and central wall 20 each extend vertically and transversely (i.e., parallel to one another), with central wall 20 being spaced apart from sidewall 18 by a distance b, and with central wall 20 being spaced apart from sidewall 16 by a distance d.

The first sidewall 16 has vertically opposed upper and lower edges 22, 24, respectively, with the first side edge 26 of the upper wall 14 being joined to the upper edge 22 of the first sidewall 16. The upper wall 14 extends laterally therefrom (to the left in the orientation of FIG. 1), with the first side edge 30 of the lower wall 12 being joined to the lower edge 24 of the first sidewall 16, and with the lower wall 12 extending laterally therefrom (also to the left in the orientation of FIG. 1). The upper edge 38 of the central wall 20 is joined to the second side edge 28 of the upper wall 14, with the central wall 20 extending downwardly therefrom (vertically, so as to be parallel with sidewalls 16, 18) such that the lower edge 40 of the central wall 20 is spaced apart from the lower wall 12. A lower edge 34 of the second sidewall 18 is joined to the second edge 32 of the lower wall 12, with the second sidewall 18 extending upwardly therefrom such that an open channel is formed between the second sidewall 18 and the central wall 20.

As shown in FIG. 4, convection baffle 10 is received within passage P such that sidewall 16 contacts the sidewall PI of passage P closest to the interior of the building; i.e., the coolest region with an interior temperature of $T_c$. Because sidewall 16 has a height H, matching the height of passage P, convection baffle 10 is held securely within passage P by frictional engagement of sidewall 16 with wall $P_1$, upper wall 14 with wall $P_4$, and lower wall 12 with wall $P_3$. For a square passage having dimensions H by H, sidewall 18 is spaced apart from wall $P_2$ by a distance of H-3t-b-d, and the upper edge 36 of sidewall 18 is spaced apart from wall $P_4$ by a distance of H-h. Preferably, central wall 20 also has a height of h, thus the lower edge 40 of central wall 20 is spaced apart from wall P3 also by a distance of H-h.

Air with the highest temperature is located between sidewall 18 and wall $P_2$, with wall $P_2$ facing the exterior, where the external temperature is $T_h$. This heated air rises within this space (indicated by flow arrow $A_1$ in FIG. 4), and wall P4 and the passage defined between sidewall 18 and central wall 20 deflect the air downwardly (indicated by flow arrow $A_2$ in FIG. 4). Conversely, the cooler air, located between central wall 20 and sidewall 16, falls within this cooler region (flow arrows $A_3$), and is deflected upwardly by the U-shaped bend defined by sidewalls 18, 16 and central wall 20 (flow arrows $A_4$).

The opposed air flows $A_2$ and $A_4$ act against one another in the region between sidewall 18 and central wall 20, thus causing overall airflow within passage P to be minimized. The cancellation of the internal air currents greatly decreases the heat transfer by convection within the passage P, thus increasing the R-value of the block or, in other words, increasing the thermal insulating properties of the block B. The material forming baffle 10, and the distances b and d, as well as thickness t, may be adjusted for varying conditions to increase the overall R-value of a particular hollow block.

It is to be understood that the present invention is not limited to the embodiment described above, but encompasses any and all embodiments within the scope of the following claims.

I claim:

1. A convection baffle for hollow blocks, comprising:

an upper wall having laterally opposed first and second side edges;

a lower wall having laterally opposed first and second side edges;

first and second laterally opposed sidewalls; and a central wall having opposed upper and lower edges, the first sidewall having vertically opposed upper and lower edges, the first side edge of the upper wall being joined to the upper edge of the first sidewall, the upper wall extending laterally therefrom, the first side edge of the lower wall being joined to the lower edge of the first sidewall, the lower wall extending laterally therefrom, the upper edge of the central wall being joined to the second side edge of the upper wall, the central wall extending downwardly therefrom so that the lower edge of the central wall is spaced apart from the lower wall and terminates in a free edge, and a lower edge of the second sidewall being joined to the second edge of the lower wall, the second sidewall extending upwardly therefrom and terminates in a free edge so that an open channel is formed between the second sidewall and the central wall, wherein said central wall is positioned between said first and second laterally opposed sidewalls, said central wall being laterally spaced apart from each of said first and second laterally opposed sidewalls;

wherein said first sidewall has a first height and said second sidewall has a second height, wherein said first height is greater than said second height;

wherein the convection baffle is adapted to be disposed within a passage of a hollow block so that the first sidewall thereof is positioned adjacent and contiguous to a relatively low temperature wall of the hollow block, the second sidewall being positioned to extend substantially parallel to a relatively high temperature wall of the hollow block, the second sidewall being spaced apart therefrom, convection air flow in a heated region defined by the relatively high temperature wall, the second sidewall and the central wall being at least partially canceled by convection air flow in a cooled region defined by the first sidewall, the central wall and the second sidewall, the heated region being defined by the high temperature wall, the second sidewall and the central wall, and the cooled region being defined by the first sidewall, the central wall and the second sidewall.

2. The convection baffle for hollow blocks as recited in claim 1, wherein said first sidewall has a height defined by H and said second sidewall has a height defined by h, H being greater than h.

3. The convection baffle for hollow blocks as recited in claim 1, wherein said second height is greater than ½ said first height.

4. The convection baffle for hollow blocks as recited in claim 3, wherein said central wall has a height equal to said second height.

5. The convection baffle for hollow blocks as recited in claim 1, wherein said upper and lower walls are positioned parallel to one another.

6. The convection baffle for hollow blocks as recited in claim 5, wherein said first and second sidewalls and said central wall are positioned parallel to one another.

7. The convection baffle for hollow blocks as recited in claim 1, in combination with a hollow block.

* * * * *